US005203686A

United States Patent [19]

Scheldorf et al.

[11] Patent Number: 5,203,686

[45] Date of Patent: Apr. 20, 1993

[54] ROTARY COMPRESSOR WITH SPAN TYPE DISCHARGE VALVE

[75] Inventors: Owen H. Scheldorf; Gary O. Scheldorf; James F. Gordon, all of Louisville, Ky.

[73] Assignee: General Electric Company, Louisville, Ky.

[21] Appl. No.: 965,542

[22] Filed: Oct. 23, 1992

Related U.S. Application Data

[63] Continuation of Ser. No. 787,102, Nov. 4, 1991, abandoned.

[51] Int. Cl.[5] ..... F01C 1/02

[52] U.S. Cl. ..... 418/63; 418/270; 137/851

[58] Field of Search ..... 418/63, 270; 137/851, 137/856, 857

[56] References Cited

U.S. PATENT DOCUMENTS

| | | | |
|---|---|---|---|
| 2,372,938 | 4/1945 | Doeg | 137/851 |
| 4,257,457 | 3/1981 | Namura et al. | 137/851 |
| 4,325,680 | 4/1982 | Bar | 137/851 |
| 4,373,882 | 2/1983 | Ladusaw | 418/270 |
| 4,580,604 | 4/1986 | Kawaguchi et al. | 418/270 |
| 4,605,362 | 8/1986 | Sturgeon et al. | 418/63 |
| 4,801,250 | 1/1989 | Lammers | 137/851 |
| 4,955,797 | 9/1990 | Cowen | 418/270 |

*Primary Examiner*—Richard A. Bertsch
*Assistant Examiner*—W. J. Wicker
*Attorney, Agent, or Firm*—Radford M. Reams; H. Neil Houser

[57] ABSTRACT

The valve assembly for a rotary compressor includes an elongated valve member which rests on pads on each side of the valve seat and includes an intermediate sealing section normally sealing against the valve seat. An elongated valve spring biases the sealing section toward engagement with the valve seat. An elongated spring backer sits on one end of the valve spring and the other end of the valve member. One end of each of the valve member, valve spring and spring backer are bolted to the compressor end plate. The other end of the spring backer permits the corresponding end of the valve member to slide along the end plate as the valve member moves between its open and closed positions, while restraining the end of the valve member from moving away from the end plate. A backer support, positioned between the spring backer and the head of the bolt, spreads the clamping force and defines a line about which the valve member and valve spring flex.

7 Claims, 3 Drawing Sheets

ROTARY COMPRESSOR WITH SPAN TYPE DISCHARGE VALVE

This application is a continuation of application Ser. No. 07/787,102, filed Nov. 4, 1991 now abandoned.

BACKGROUND OF THE INVENTION

The present invention relates to rotary compressors and, more particularly, to such compressors with an improved discharge valve assembly of the span type.

Typically, rotary compressors include a hermetic outer casing in which there is disposed a refrigerant or other gas compressor unit. The compressor unit includes a cylindrical side wall and a pair of end plates defining a a cylindrical compression chamber. A roller is positioned in the chamber and is driven by an eccentric formed on a motor driven drive shaft. A vane is mounted in the cylindrical wall and rides against the roller to divide the chamber into a low pressure and a high pressure side. A discharge passage extends through one end plate to connect the high pressure side to the interior of the casing outside the compressor unit. The outer surface of the end plate is provided with a valve seat which surrounds the end of the discharge passage. A flapper valve mechanism is mounted to one side of and extends over the seat. The valve mechanism opens when the pressure of the refrigerant reaches a predetermined high level and allows high pressure gas to exit the chamber to the space inside the casing. The valve opens and recloses very quickly, for example, in no more than about 4/1000 of a second. In addition, it is desirable for the valve action to be clean and without flutter. Flapper valves tend to open from the side opposite their mounting and to close in the opposite manner, rather than to open and close perpendicularly to the seat. Moreover, flapper valves tend to have a reed action in that they vibrate from side-to-side and end-to-end and twist about their longitudinal axis. All of these characteristics detract from optimum operation of the valve assembly.

SUMMARY OF THE INVENTION

One object of the present invention is to provide a rotary compressor with an improved discharge valve mechanism.

Another object is to provide such an improved mechanism in which the discharge valve operates quickly and surely.

Still another object of this invention is to provide a rotary compressor with a span valve type of discharge valve.

In accordance with one form of the invention, there is provided a rotary compressor including a cylindrical wall and a pair of end plates forming a compression chamber having a low pressure and a high pressure side. A discharge passage extends through one of the end plates and a valve seat is provided at the outer face of the plate around the discharge passage. A pair of mounting pads are formed on opposite sides of the valve seat. An elongated valve member has its opposite ends resting on the pads and extends across the valve seat to normally seal against the seat and move away when a predetermined pressure exists in the chamber. An elongated spring backer overlies the valve member and has distal ends resting on the ends of the valve member. A bolt is received in the plate and secures one end of the valve member and spring backer against the corresponding pad. The other end of the backer permits the other end of valve member to slide longitudinally as the member opens and closes while biasing that end of the member into contact with the other pad.

DESCRIPTION OF THE PREFERRED EMBODIMENTS

U.S. Pat. No. 4,605,362, issued on Aug. 12, 1986 to Gerald E. Sturgeon et al and assigned to General Electric Company, assignee of the present invention, is incorporated herein by reference. That patent illustrates and describes a rotary compressor in which a rotary compressor unit is mounted within a hermetically sealed outer casing. A flapper valve mounted to one end plate controls discharge of high pressure refrigerant from the compressor unit to the hermetic casing outside the unit.

Figure 1:
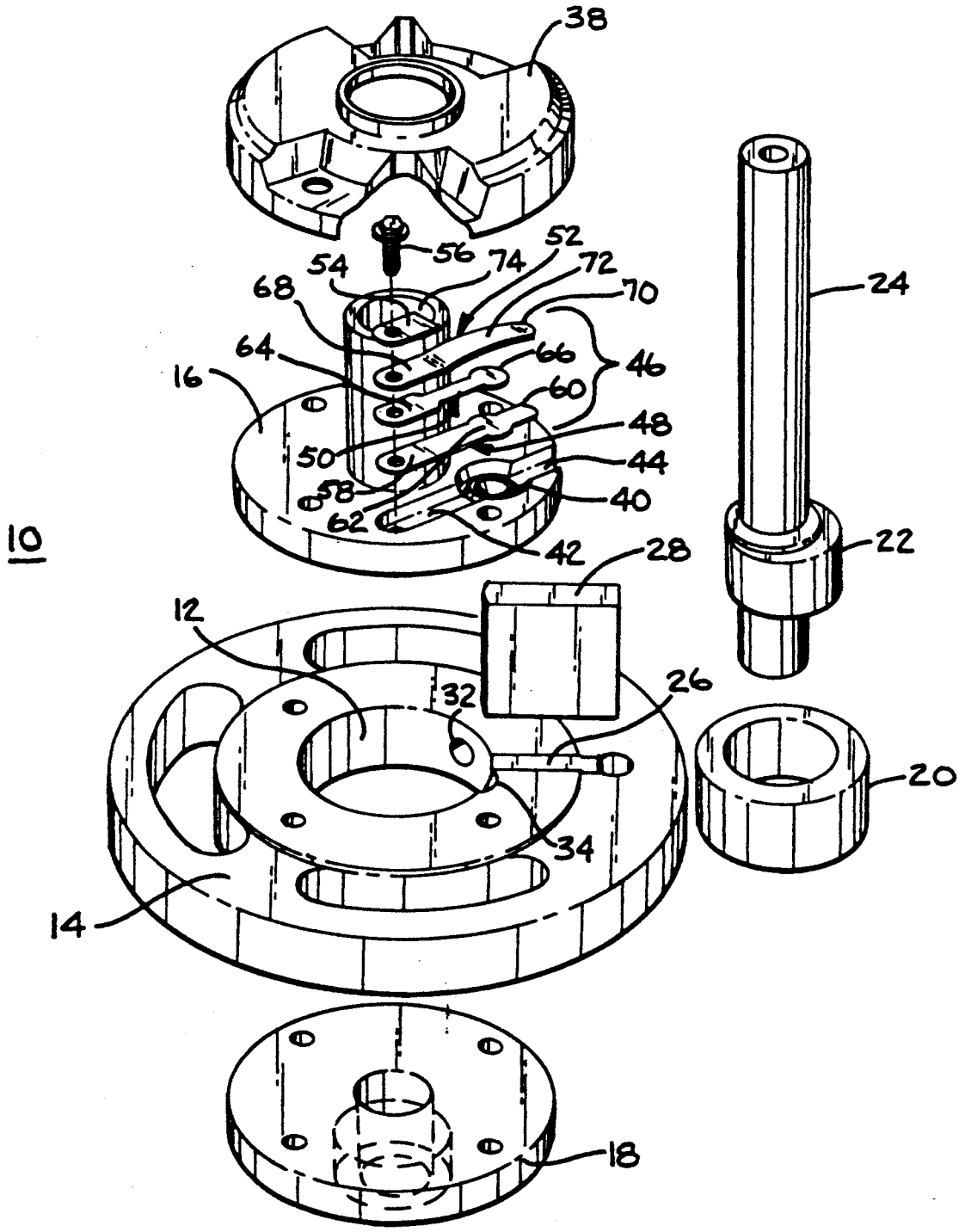
FIG. 1 is an exploded perspective view of the compressor unit of a hermetic refrigeration compressor incorporating one embodiment of the present invention.
Figure 2:
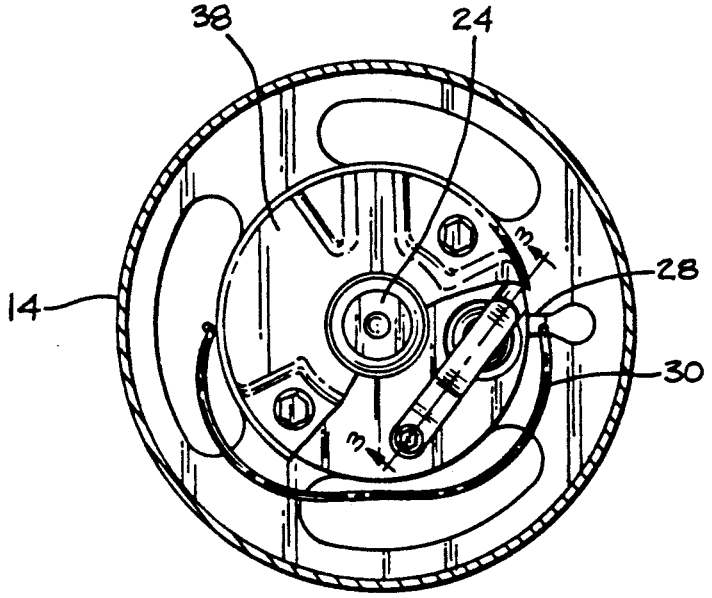
FIG. 2 is a top plan view of the compressor unit of FIG. 1.

Referring now to the drawings and, more particularly, to FIGS. 1 and 2. there is disclosed a rotary compressor unit 10 having an annular compression chamber 12 defined within a cylindrical side wall 14 and bounded by end plates 16 and 18. A roller 20 is disposed for rotation within the chamber 12 and is driven by an eccentric 22 formed integrally with a drive shaft 24. The shaft is supported by suitable bearings in the end plates and is rotated by a suitable electric motor, not shown, as is well known in the art.

Figure 3:
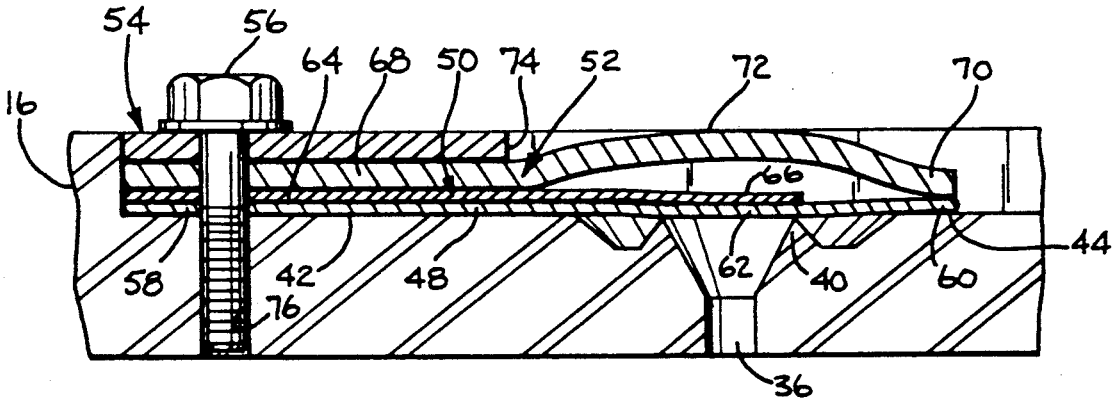
FIG. 3 is a fragmentary cross sectional view generally as seen along line 3—3 in FIG. 2, showing the span valve mechanism in its closed configuration.
Figure 4:
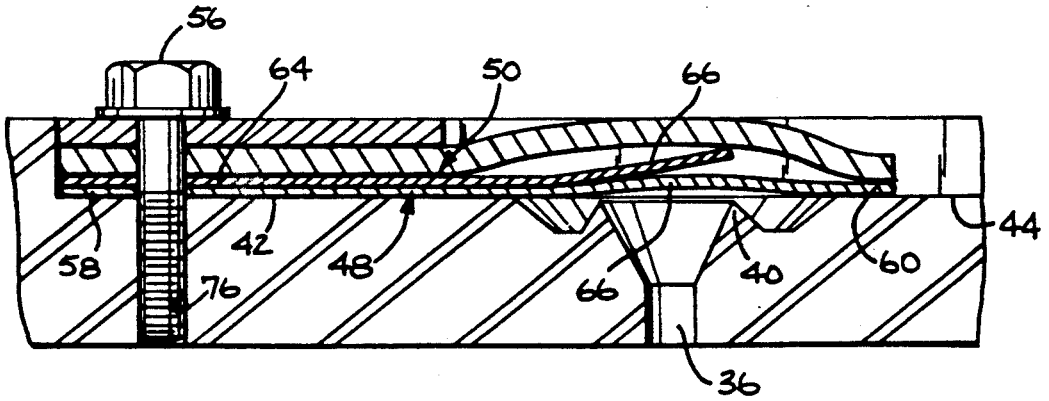
FIG. 4 is a fragmentary cross-sectional view similar to FIG. 3, but showing the span valve in an open configuration.

The cylinder is provided with a radially extending slot 26 and a vane 28 is slidably received in the slot. A spring 30, see FIG. 2, biases the vane into contact with the outer surface of the roller to divide the chamber 12 into a low pressure side and a high pressure side. The shaft 24 rotates the roller within the chamber in a counterclockwise direction, as viewed in FIG. 1, to draw low pressure refrigerant gas into the chamber through an inlet passage 32 and to discharge high pressure compressed refrigerant gas through a discharge channel 34. As best seen in FIGS. 3 and 4, the end plate 16 is provided with a discharge passage 36 which communicates with the discharge channel 34 so that the high pressure gas exits from the compression chamber to the space in the hermetic casing outside the compressor unit 10. A muffler 38, see FIG. 1, is positioned over the end plate 16 to reduce transmission of noise generated by the exiting refrigerant.

The outer or exit end of the passage 36 is provided with a valve seat 40 of circular or ring like configuration. As best seen in FIG. 1, the valve seat is located in a slight recess in the outer surface of the end plate 16. A pair of mounting pads 42 and 44 are formed in the outer surface of plate 16 and are spaced apart so that they are positioned on opposite sides of the valve seat 40. As seen in FIGS. 3 and 4, the outer edge of the valve seat 40 is slightly below the mounting pads 42 and 44, which lie in substantially the same plane. This positions the valve seat slightly upstream of the mounting pads relative to the path of the refrigerant gas exiting from the chamber 12.

A valve assembly 46 includes a valve member 48, a valve spring 50, a spring backer 52, a backer support 54 and a bolt 56. The valve member 48 extends across the valve seat 40 and includes spaced apart end portions 58 and 60 which rest on the pads 42 and 44 respectively. The central portion of the valve member includes a generally circular sealing section 62 which is in register with the valve seat 40 and is large enough to completely cover the seat. The valve spring 50 includes a first end portion 64 which rests on the end portion 58 of valve member 48 and a circular end portion 66 which engages the circular sealing section 62 of the valve member. The spring backer 52 includes a first end portion 68 which rests on the end portion 64 of the valve spring 50 and a second end portion 70 which engages the end portion 60 of the valve member 48. The intermediate portion 72 of the spring backer curves or arches away from the valve seat 40 to provide clearance for operation of the valve assembly, as will be explained more fully hereafter. The backer support 54 rests on the first end portion 68 of the spring backer 52 and includes an edge 74 which is disposed generally perpendicular to the longitudinal axis of the valve assembly 46. The parts of the valve assembly are placed on the end plate 16 in the configuration described and are secured to the end plate by means of the bolt 56 which passes through holes in the various members of the assembly and is received in a threaded opening 76 in the end plate. The backer support 54 evenly spreads the pressure from the bolt over the ends of the members in register with the pad 42 and the edge 74 of the backer support 54 defines the line about which the valve member and valve spring will bend during operation.

Normally, the valve assembly assumes the configuration shown in FIG. 3, with the circular end portion 66 of the spring 50 biasing the central portion of valve member downwardly so that sealing section 62 forms a gas tight seal with valve seat 40. When the pressure of the refrigerant gas in the high pressure side of chamber builds to a predetermined level, the sealing section 62 of valve member 48 flexes upwardly against the force of the valve spring to the position shown in FIG. 4 and gas passes between the section 62 and valve seat 40. When the pressure in the chamber falls sufficiently, the valve assembly returns to the configuration shown in FIG. 3. The valve member and valve spring flex about the line defined by the end 74 Of the backer support 54 as they move between their open and closed positions. The length and positioning of the components is apportioned so that the center of the valve seat 40 and the center of the sealing section 62 are substantially centered between the edge 74 and the area of engagement of the end portion 70 of spring backer 52 with end portion 60 of valve member 48. This assists in assuring that the sealing section moves substantially perpendicularly to the valve seat 40 as it opens and closes. The pressure of end portion 70 against end portion 60 permits the valve member 48 to slide over the pad 44 as the valve opens and closes while biasing the end portion 60 of valve member 48 against lifting off the pad. This operation is enhanced by rounding over the edge of end portion 60 so that it will not dig into the surface of pad 44. In addition, the configuration of the span valve assembly 46 minimizes any flutter of the valve member. In an exemplary valve assembly, the valve member was constructed from six mil high carbon spring steel, the valve spring was constructed from eight mil high carbon spring steel, the spring backer was constructed from twenty mil high carbon spring steel and the backer support was constructed from twenty mil low carbon steel.

Figure 5:
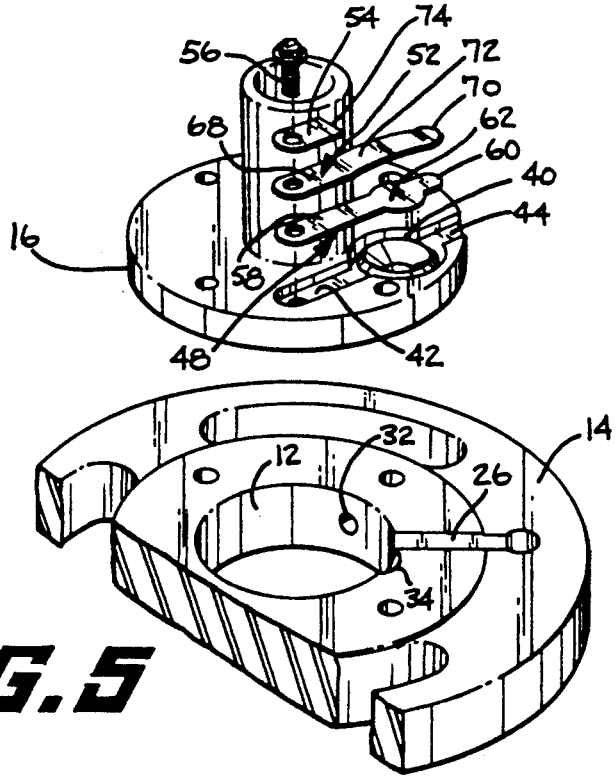
FIG. 5 is a partial exploded perspective view similar to FIG. 1, illustrating the incorporation of another span valve assembly.
Figure 6:
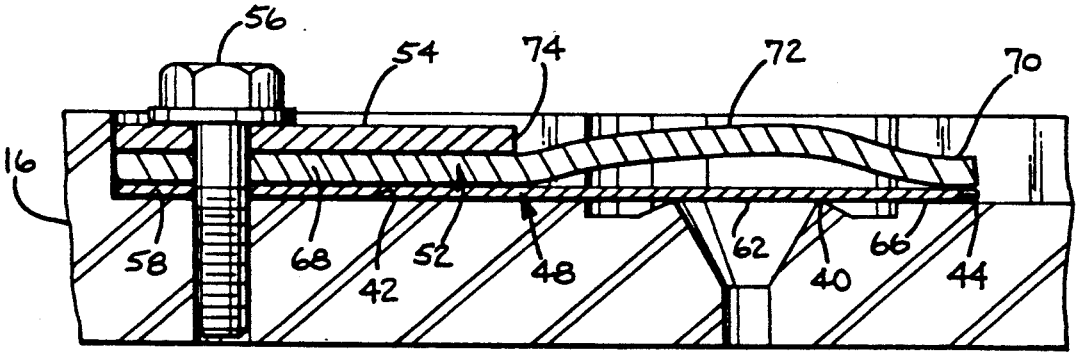
FIG. 6 is a fragmentary cross-section view similar to FIG. 3, illustrating the span valve assembly of FIG. 5 in its closed configuration.
Figure 7:
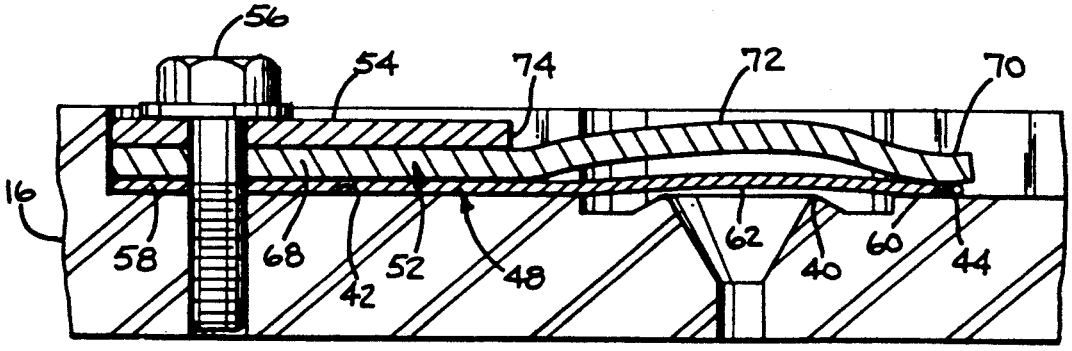
FIG. 7 is a fragmentary cross-sectional view similar to FIG. 6, illustrating the spin valve assembly of FIG. 5 in an open configuration.

In the embodiment of FIGS. 1–4, the valve seat 40 is offset slightly up stream of the pads on which the valve assembly is mounted and the valve spring biases the valve member against the valve seat. This assures a gas tight seal between the valve member and valve seat, despite variations in the manufacturing processes. When the time and expense is spent to assure very close tolerances in the manufacturing processes, then a simplified assembly, as shown in FIGS. 5–7 is preferable. As the construction is substantially similar to that illustrated in FIGS. 1–4, like numerals are used to identify like parts. In this embodiment, the valve seat 40 is in substantially the same plane as the pads 42 and 44. The sealing section 62 of the valve member 48 seats against the valve seat 40 without the need of outside force and thus the valve spring has been omitted. In other significant respects, this embodiment is like the embodiment of FIGS. 1–4 in construction and operation.

What is claimed is:

1. A rotary compressor comprising:

a cylindrical side wall and a pair of end plates defining a compression chamber having a low pressure and a high pressure side;

a single high pressure discharge passage extending from said high pressure side of said chamber through a first of said plates;

a valve seat provided in the outer surface of said first plate around said passage;

first and second pads formed on said outer surface of said first plate on opposite sides of said valve seat;

a single elongated valve member having first and second distal end portions supported from said first and second pads respectively and an intermediate portion overlying said valve seat, said intermediate portion normally sealing against said valve seat and moving away from said valve seat upon a predetermined high pressure existing in said high pressure side of said chamber;

a spring backer overlying said valve member and including first and second end portions engaging said first and second end portions respectively of said valve member; and means fixedly securing said first end portion of each of said valve member and said spring backer to the corresponding pad, the second end portion of said spring backer permitting said end portion of said valve member to move longitudinally of said second pad as said intermediate portion of said valve member moves away from said seat while biasing said second end portion of said valve member against movement away from said second pad.

2. A rotary compressor as set forth in claim 1, further including: an elongated valve spring having a first end portion secured to said first pad between said valve member and said spring backer, said valve spring engaging said intermediate portion of said valve member to resiliently urge said intermediate portion into engagement with said valve seat.

3. A rotary compressor as set forth in claim 1 wherein: said pads and said valve seat all lie in substantially the same plane.

4. A rotary compressor as set forth in claim 2 wherein said pads lie in substantially the same plane and said valve seat is up stream of said exit passage relative to said pads.

5. A rotary compressor as set forth in claim 1, further including: a backer support secured to the side of said first end portion of said spring backer opposite said valve member, said backer support extending along said spring backer and terminating short of said valve seat, said spring backer being formed as an arch projecting away from said valve member between the termination of said backer support and the engagement of said second end portions of said spring backer and said valve member.

6. A rotary compressor as set forth in claim 5, wherein: said valve seat is substantially centered between the terminus of said backer support and the engagement of said spring backer and said valve member.

7. A rotary compressor as set forth in claim 1, wherein: said valve seat is substantially circular in cross section and said intermediate portion of said valve member includes a substantially circular section of a larger diameter than and positioned in register with said valve seat.

* * * * *